US005738032A

United States Patent [19]

Cox

[11] Patent Number: 5,738,032

[45] Date of Patent: Apr. 14, 1998

[54] COMPOUND SAIL FOOT CONSTRUCTION FOR IMPROVED KINETICS

[76] Inventor: Jerry E. Cox, 310 E. 74th St., New York, N.Y. 10021

[21] Appl. No.: 701,598

[22] Filed: Aug. 22, 1996

Related U.S. Application Data

[60] Provisional application No. 60/002,880 Aug. 28, 1995.

[51] Int. Cl.[6] ..... B63H 9/04

[52] U.S. Cl. ..... 114/103

[58] Field of Search ..... 114/39.1, 39.2, 114/102, 103, 104

[56] References Cited

U.S. PATENT DOCUMENTS

| | | | |
|---|---|---|---|
| 2,499,598 | 3/1950 | Maurer et al. | 114/103 |
| 3,820,493 | 6/1974 | Amick | 114/103 |
| 4,706,591 | 11/1987 | Reynolds | 114/103 |
| 4,951,589 | 8/1990 | Pfeffer | 114/103 |
| 5,038,699 | 8/1991 | Cochran et al. | 114/103 |

FOREIGN PATENT DOCUMENTS

| | | | |
|---|---|---|---|
| 2687121 | 8/1993 | France | 114/103 |
| 99054 | 11/1961 | Norway | 114/103 |

*Primary Examiner*—Stephen Avila

*Attorney, Agent, or Firm*—Stroock & Stroock & Lavan LLP

[57] ABSTRACT

A panel to couple to a sail is provided. The sail includes a tack and clew and a foot chord essentially positioned between the tack and clew. The panel includes a first arc having a first end and a second end and a second are having a first end and a second end. The first ends of each of the first and second arcs meet at a first point, while the second ends of the first and second arcs meet at a second point. A chord is essentially positioned between the first and second points dividing the panel into a first region and a second region in a lengthwise direction. The length of each region is greater than its width. The are of the panel is attached essentially between the tack and clew substantially along the foot chord of the sail. The first points of the arc are positioned substantially towards the tack and the second points of the arc are substantially positioned towards the clew.

16 Claims, 4 Drawing Sheets

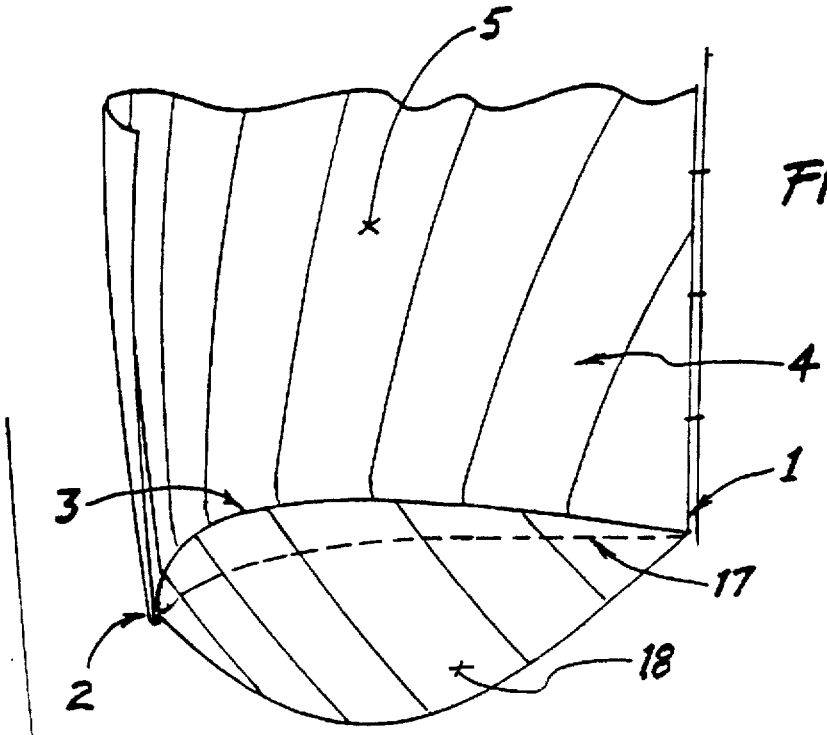
FIG. 1
FIG. 7
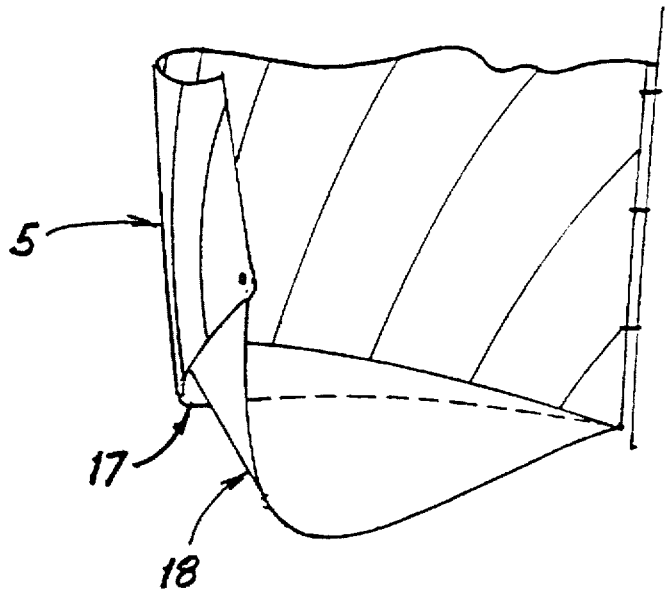
FIG. 8
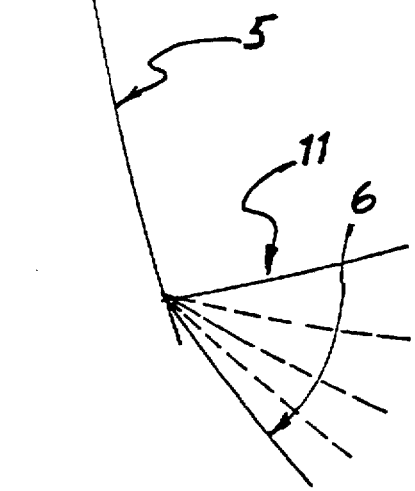

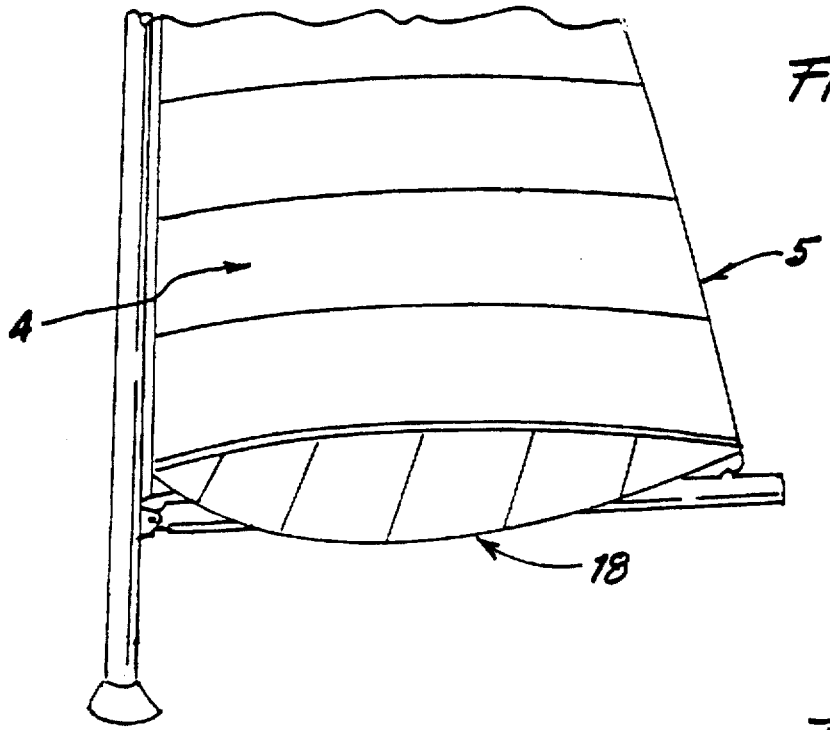
FIG. 5
FIG. 6
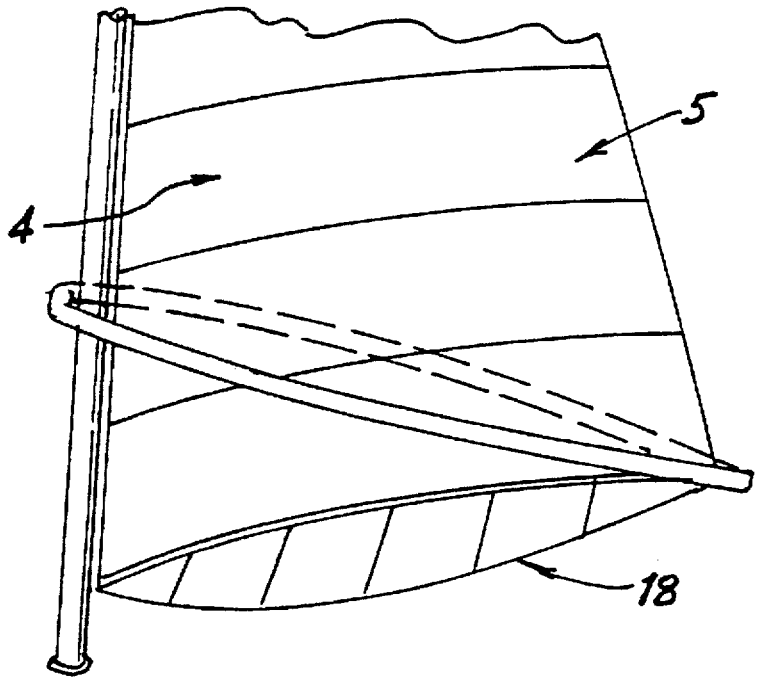

COMPOUND SAIL FOOT CONSTRUCTION FOR IMPROVED KINETICS

CROSS-REFERENCE

This is a continuation application of Provisional application Ser. No. 60/002.880 filed Aug. 28. 1995.

BACKGROUND OF INVENTION

This invention relates generally to a sail and, in particular, to a compound sail foot construction for improved kinetics.

The dynamics of sail propulsion have been well-documented over the past 3.500 years. However, the limitations of conventional two-dimensional monoplanal sails have only recently become reasonably well understood especially the rigs of fore-and-aft vessels, where sails must function on-wind as well as off-wind.

With respect to on-wind, thrust is generated during an air pressure/velocity differential in the forward section of the sail. Air velocity is higher and sail pressure is negative, or sub-atmospheric, on the leeward side. On the weather side, velocity is lower and pressure is higher. These relative values must mitigate to zero by the time they reach the trailing leach edge to achieve the ideal Kotta Condition—a match of airflow velocity and pressure necessary for minimum drag. Unfortunately, upwash and especially downwash from the pressure surface cause an imbalance of those velocities/pressures at the leach edge, and vortices result not only at the leach, but also along the foot of the sail.

Under off-wind conditions, thrust is generated by high pressure from following airflow. Pressure loads need to be balanced and stable, with as little leakage as possible to the leeward side. Secondary vortices occur in the zero pressure lee side, and have negative effect when pressure becomes light on the weather side. In genoas and other stay-attached headsails, much efficiency is lost due to the stay angle and the difficulty of damping down draft and resulting foot vorticity. In spinnakers, too, foot leakage is a problem, even with the pressure gradient lowest in that area.

Aerodynamic efficiency of a sailboat will depend to a large extent on the gap between the sailfoot and sea, whether the sail is soft or rigid. Many attempts have been made to improve the efficiency surrounding this gap including those described in U.S. Pat. No. 4.951.589, U.S. Pat. No. 3.820, 493 and French Patent No. 2552393. Accordingly, it is desired to create a sail construction that is a simple, practical solution for minimizing that gap.

SUMMARY OF THE INVENTION

Generally speaking, a panel to couple to a sail is provided. The sail includes a tack and clew and a foot chord essentially positioned between the tack and clew. The panel includes a first arc having a first end and a second end and a second are having a first end and a second end. The first ends of each of the first and second arcs meet at a first point, while the second ends of the first and second arcs meet at a second point. A chord is essentially positioned between the first and second points dividing the panel into a first region and a second region in a lengthwise direction. The length of each region is greater than its width. The are of the panel is attached essentially between the tack and clew substantially along the foot chord of the sail. The first points of the arc are positioned substantially towards the tack and the second points of the arc are substantially positioned towards the clew.

Accordingly, it is an object of the invention to provide an improved sail mechanism.

It is another object of the invention to have a sail which serves to mitigate the net downwash and result in trailing vortices and converts the vortices into thrust instead of induced drag.

It is another object of the invention to provide a sail which serves as a pressure shunt to moderate pressure disparity inherent between weather and leeward surfaces of the primary sail along the extended foot edge.

Yet another object of the invention is to provide a sail which produces thrust at a lower center of gravity that will enhance efficiency and stability in the overall air flow.

It is another object of the invention to provide a sail which adds sail area vertically instead of horizontally to help maintain aero hydrodynamic balance in the vessel underway.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF DRAWING

For a fuller understanding of the invention, reference is had to the following description taken in connection with the accompanying drawings, in which:

FIG. 1 is a front elevational view of a first embodiment of the shurl attached to a sail in accordance with the invention;

FIG. 5 is a front elevational view of a shurl on a loose-looted mainsail;

FIG. 6 is a front elevational view of a shurl for loose-footed mainsails or board sails for wind surfing;

FIG. 7 is a perspective view of the shurl at three-quarters extension in a genoa droop to leeward; and FIG. 8 is a cross-sectional view of the shurl orientation and reaction to primary sail camber.

DETAILED DESCRIPTION OF THE PREFERRED EMBODIMENT

Figure 2:
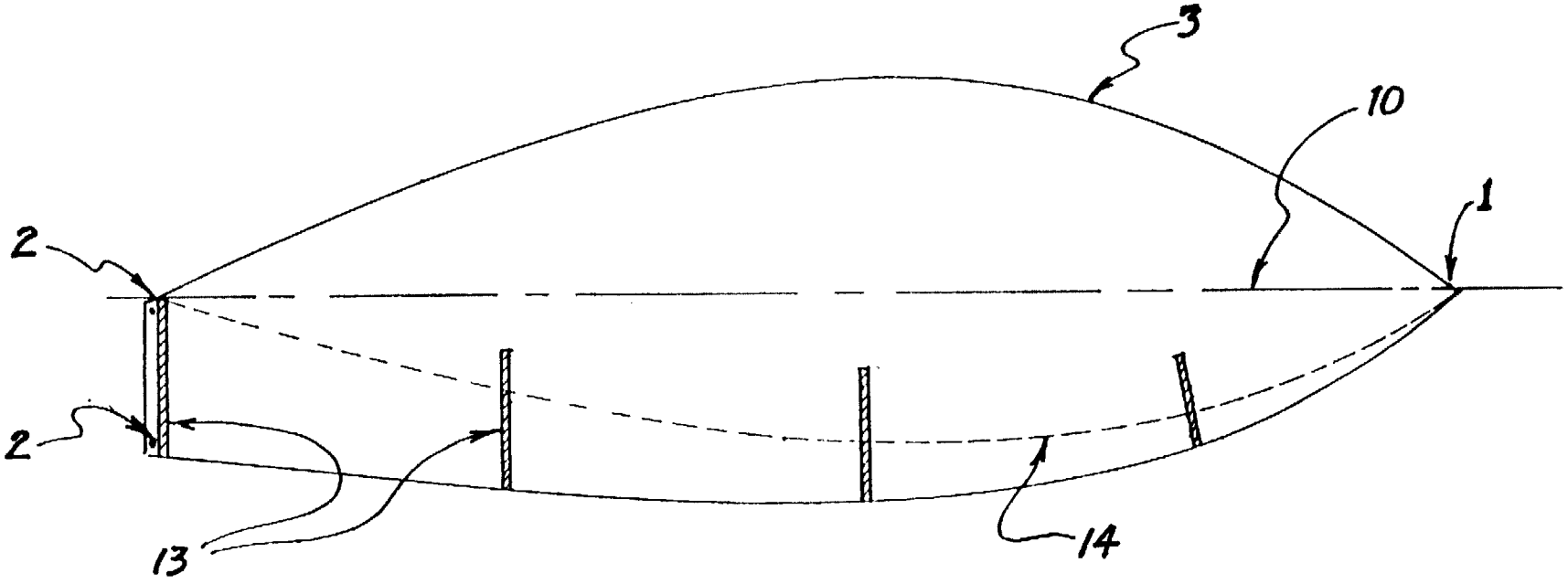
FIG. 2 is a front elevational view of a second embodiment of the shurl in an extreme condition in accordance with the invention.

This invention is a structure comprised of a fore-and-aft sail with a freely suspended, unreinforced panel attached essentially perpendicularly along the foot of the fore and aft sail. This "panel" will hereinafter be referred to as a shurl. Referring generally to FIG. 1, a shurl 18 is attached to a sail 5. It is noted that like numbers are used to denote like parts throughout the application. Shurl 18 may be permanently attached and is reversible, as in the case of an asymmetrical spinnaker or a reaching headsail, or it may be simply zipped in either side for other embodiments. "Zipped in" means any quick method of attachment or detachment. Accordingly, shurl 18 may be attached quickly by a zipper 23 alone in the non-permanent embodiments and can be removed by starting the zipper and ripping it out—a matter of three to five seconds with proper lubrication. In a preferred embodiment, shurl 18 attaches at a point near a tack 1 and continues in a straight line at the foot chord of sail 5 directly to a clew 2 at its upper edge 3.

As disclosed, shurl 18 is made of any material relative to the weight of the primary sail—whether it be dacron, reinforced dacron, or tougher, later generation synthetics that may be used over a broaden span of wind conditions. Shurl 18 is constructed to be servant to airflow pressure represented by arrow 4 affecting it along its full length, and can be described as two airfoil arcs defining variable surface areas between tack 1 and clew 2 of primary sail 5. Shurl 18 interacts with primary sail 5 by dropping to an angle 6 as shown in FIG. 8 based on the amount of camber in that structure. The combination of primary sail 5 and the like and shurl 18 is a duoplanal configuration that interacts to produce a more efficient airflow in the most simple and effective manner. As used herein, duoplanal means a compound structure designed on two separate two-dimensional planes to function as one structure.

Figure 3:
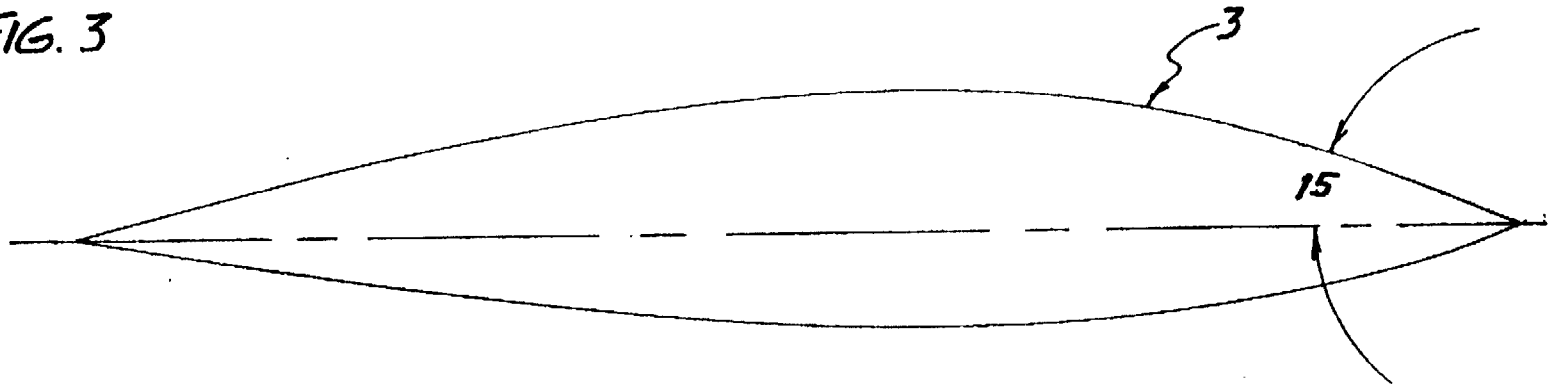
FIG. 3 is a front elevational view of a third embodiment of the shurl for closer windward use in accordance with the invention.
Figure 4:
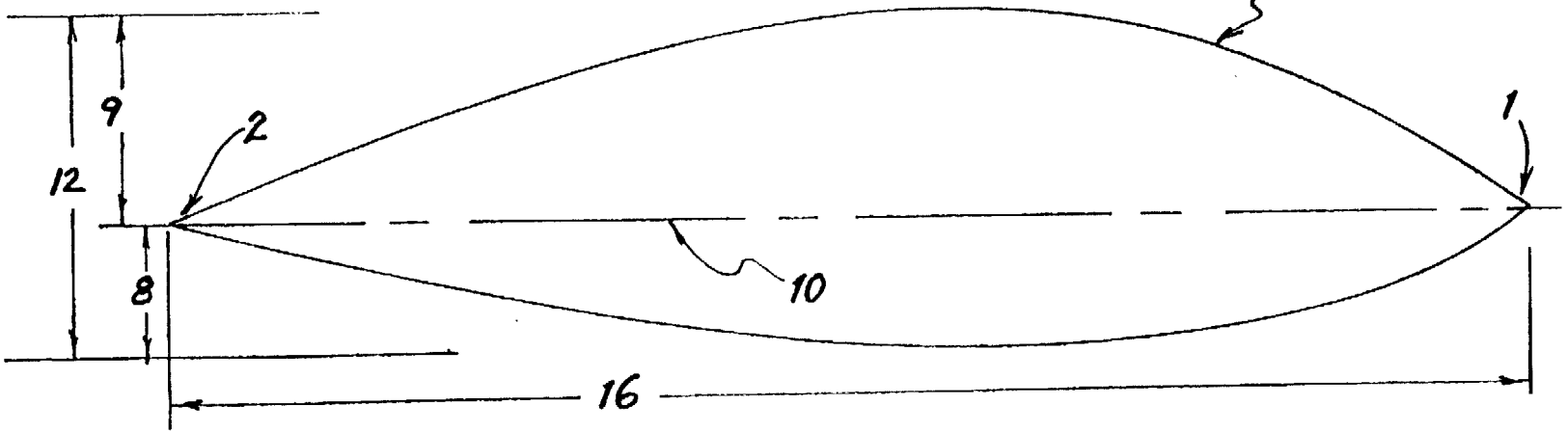
FIG. 4 is a front elevational view of a fourth embodiment of the shurl for off-wind use in accordance with the invention.

The integrity of shurl 18 may be maintained without a drawstring. As shown in FIG. 4, shurl 3 is divided into a lower segment 8 and a upper segment 9. The total width of shurl 3 is represented by numeral 12, while its length is represented by numeral 16. The positioning of these segments are above and below a median chord line 10 of shurl 3. Lower segment 8 of shurl 3 is no more than 65% of upper segment 9 in depth. Shurl 3 of FIG. 3 may open to a lower angle 6 as shown in FIG. 8 or may elevate to a more closed position 11 relative to the amount of camber in the primary structures and longitudinal tension 16 of shurl 3.

A single shurl representing about 14% of the primary sail's area broadly serves to improve performance under off-wind conditions. However, two or three versions may be desirable in racing level performance. Other shurl configurations include the use of battens 13 as shown in FIG. 2 in the lower segment to extend or otherwise distend shurls 3 shape beyond the simple version 14 represented by dashed lines to give a closer water or hull orientation.

A conventional, asymmetrical spinnaker or non-roller furling genoa may include a shurl as a permanent structural member. In such an embodiment, the shurl could add at least 20% more additional sail area for strictly off-wind use such as shurl 3 disclosed in FIG. 4, or as little as 10% additional area for close-haul work by adding shurl 3 of FIG. 3. Shurl 3 of FIG. 3 may also be used at greater angles of incidence, but a larger variation is then more desirable. As described above, a separate shurl may be zipped into a roller-furled headsail in the unfurled position. Any size variation of the former embodiment is applicable, but must be removed before refurling. The shurl can be reattached on the opposite side when vessel changes tacks, because of the genoa's droopy foot (e.g., represented by dashed line 17 in FIGS. 1 and 7). A separate shurl may also be zipped into, or permanent in the mainsail foot, loose-looted as shown in FIG. 5 or FIG. 6. The entry angle 15 as shown in FIG. 3 is more critical here and would probably be around 20–22% at the upper segment of the shurl, depending on the chord near the foot of the main. As shown in FIG. 6, a shurl 18 is incorporated into primary sail 5 of a windsurfer. In this embodiment, shurl 18 would be most practical in the fixed, compound, and more narrow style, but could be temporarily attached to existing sails.

Accordingly, a shurl connected to a primary sail provides many advantages and improvements over the prior art. A shurl as described (1) serves to mitigate net downwash and resultant trailing vortices and converts the vortices into thrust instead of induced drag; (2) serves as a pressure shunt to moderate pressure disparity inherent between weather and leeward surfaces of the primary sail at the shurl's extended foot edge; (3) produces thrust at a lowered center of effort that will enhance efficiency and stability in the airfoil overall; (4) lowers the airfoil's center of effort and facilitates lighter or more effective ballast; (5) minimizes turbulence in the upper bound vortices off-wind and helps prevent sail collapse at lower wind velocities; (6) is highly cost-effective through lack of structural members, end fittings or other encumbrances; (7) adds sail area vertically instead of horizontally to help maintain aerohydrodynamic balance in the vessel underway; (8) promotes stronger, safer vessel construction through an improved thrust to weight ratio; (9) reinforces a more desirable shape in headsails downwind by balancing and stabilizing pressures; and (10) reduces the vessel's healing moment and leeway, while maximizing the propulsion/drag ratio.

It will thus be seen that the objects set forth above, among those made apparent from the preceding description, are efficiently attained and, since certain changes may be made in the above constructiosn without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A panel to couple to a sail, said sail including a tack and clew and a foot chord edge essentially positioned between the tack and clew, comprising: a first are having a first end and a second end, a second arc having a first end and a second end, said first ends of said first and second arcs meeting at a first point and said second ends of said first and second arcs meeting at a second point, a chord positioned essentially between said first and second points dividing said panel into a first region and a second region in a lengthwise direction, said length of each region being greater than its width, said first arc of said panel being attached essentially between said tack and clew substantially along said foot chord of said sail, the first point of said arcs being positioned substantially towards said tack and said second point of said arcs being substantially positioned towards said clew, said first region being essentially positioned toward said sail and said second region being essentially positioned away from said sail, said second region having a surface area and said first region having a surface area, the surface area of said second region being not greater than 65% of the surface area of the first region.

2. The panel of claim 1, wherein said first and second regions form a duoplanal structure having two distinct planes functioning as a single element.

3. The panel of claim 1, wherein said second region includes at least one envelope for receiving a batten.

4. The panel of claim 1, wherein said panel is releasably attached to said sail.

5. The panel of claim 4, wherein said panel is releasably attached by means of a zipper.

6. The panel of claim 1, wherein said panel forms a cup shaped member of said sail.

7. A sail assembly, comprising:

a sail including a tack and clew and a foot chord essentially positioned between the tack and clew; and a panel including a first arc having a first end and a second end, a second arc having a first end and a second end, said first ends of said first and second arcs meeting at a first point and said second ends of said first and second arcs meeting at a second point, a chord positioned essentially between said first and second points dividing said panel into a first region and a second region in a lengthwise direction, said length of each region being greater than its width, said first arc of said panel being attached essentially between said tack and clew substantially along said foot chord of said sail, the first point of said arcs being positioned substantially towards said tack and said second point of said arcs being substantially positioned towards said clew, said first region being essentially positioned toward said sail and said second region being essentially positioned away from said sail, said second region having a surface area and said first region having a surface area, the surface area of said second region being not greater than 65% of the surface area of the first region.

8. The sail assembly of claim 7, wherein said first and second regions form a duoplanal structure having two distinct planes functioning as a single element.

9. The sail assembly of claim 7, wherein the panel represents at least 10% of the total surface area of the sail.

10. The sail assembly of claim 7, wherein said second region includes at least one envelope for receiving a batten.

11. The sail assembly of claim 7, wherein said panel is releasably attached to said sail.

12. The sail assembly of claim 11, wherein said panel is releasably attached by means of a zipper.

13. The sail assembly of claim 7, wherein said panel forms a cup shaped member of said sail.

14. The sail assembly of claim 7, wherein said sail is a genoa.

15. The sail assembly of claim 7, wherein said sail is a fore-and-aft sail.

16. The sail assembly of claim 7, wherein said sail is a sail for a sail board.

* * * * *